US005830006A

United States Patent [19]

Koumatsu et al.

[11] Patent Number: 5,830,006

[45] Date of Patent: Nov. 3, 1998

[54] CONNECTOR WITH REAR HOLDER

[75] Inventors: Seiji Koumatsu; Takuya Kitamura, both of Shizuoka, Japan

[73] Assignee: Yazaki Corporation, Tokyo, Japan

[21] Appl. No.: 782,098

[22] Filed: Jan. 13, 1997

[30] Foreign Application Priority Data

Jan. 22, 1996 [JP] Japan ..... 8-008421

[51] Int. Cl.[6] ..... H01R 13/58

[52] U.S. Cl. ..... 439/449; 439/501

[58] Field of Search ..... 439/468, 449, 439/456, 470, 471

[56] References Cited

FOREIGN PATENT DOCUMENTS

| | | | |
|---|---|---|---|
| 5-226023 | 9/1993 | Japan | H01R 13/42 |
| 7-48387 | 5/1995 | Japan | H01R 13/58 |
| 7-288149 | 10/1995 | Japan | H01R 13/52 |

*Primary Examiner*—Khiem Nguyen
*Assistant Examiner*—Eugene G. Byrd
*Attorney, Agent, or Firm*—Sughrue, Mion, Zinn, Macpeak & Seas, PLLC

[57] ABSTRACT

A connector in which a wire-arranging operation before attachment of a rear holder can be omitted, while securing the function of preventing rearward withdrawal of terminals, thereby enhancing the efficiency of a connector-assembling operation. In the connector, wires are extended outwardly from a rear open portion of a connector housing, and a rear holder for preventing rearward withdrawal of terminals is attached to the rear open portion. The rear holder is slid in a direction perpendicular to a direction of extending of the wires to be attached to the rear open portion, and arranging walls are formed on the rear holder, and extend in the direction of sliding of the rear holder. When the rear holder is attached to the rear open portion, each of the arranging walls is passed between the corresponding ones of the wires extended outwardly from the rear open portion. In the connector, preferably, when the rear holder is attached to the rear open portion, the arranging walls are abutted respectively against rear ends of rubber plugs fitted respectively in terminal receiving chambers. In the connector, preferably, a wire-bending cover for bending the wires is mounted on the rear holder.

11 Claims, 4 Drawing Sheets

CONNECTOR WITH REAR HOLDER

BACKGROUND OF THE INVENTION

1. Field of the Invention

This invention relates to a connector provided with a rear holder for preventing rearward withdrawal of terminals.

2. Background

There is known the type of connector provided with a rear holder for preventing rearward withdrawal of terminals. FIG. 5 is an exploded, perspective view of one such conventional connector with a rear holder, and FIG. 6 is a perspective view showing the connector of FIG. 5 in its assembled condition. A plurality of terminal receiving chambers 3 are formed in a connector housing 1, and are open at a rear end of the connector housing 1. A receiving portion 7 in the form of a recess is formed in the rear end of the connector housing 1, and the rear holder 9 can be received in the receiving portion 7.

The rear holder 9 is of a generally comb-like shape, and has two wire passage grooves 11. A protective cover 15 is connected integrally to the rear holder 9 by a thin hinge portion 13, and the rear holder 9 can be received in the protective cover 15. Engagement grooves 17 are formed in the protective cover 15, and retaining piece portions 19, formed at the receiving portion 7, can be retainingly engaged in the engagement grooves 17, respectively. A press projection 21 for the rear holder 9 is formed on an inner surface of the rear holder 9.

In the conventional connector 23 of this construction, when terminals, clamped to respective wires 25, are mounted respectively in the terminal receiving chambers 3, the wires 25 are extended outwardly from the rear end of the connector housing 1. A waterproof rubber plug 27 is mounted on the wire 25, and is fitted in the terminal receiving chamber 3. In this condition, the rear holder 9 is received in the receiving portion 7. At this time, entanglement of the wires 25 is removed, and then the wires 25 are passed through the corresponding wire passage grooves 11, and are extended to the exterior. Thereafter, the protective cover 15 is pivotally moved, and the retaining piece portions 19 are retainingly engaged in the engagement grooves 17, respectively, and the rear holder 9 is pressed by the press projection 21, so that the rear holder 9 is held between a bottom surface 7*a* of the receiving portion 7 and the protective cover 15. At the same time, the wires 25 are extended outwardly from a wire outlet port 15*a*, formed in the protective cover 15*a*, in a juxtaposed manner.

In the connector 23 of this construction, the wires 25 could be bent in a predetermined direction, and the rear holder, 9 held between the bottom surface 7*a* and the protective cover 15, could prevent the terminals and the waterproof rubber plugs 27 from rearward withdrawal.

In the above connector 23, however, the receiving portion 7 is formed in the rear end of the connector housing 1, and after the wires 25, extended from the receiving portion 7, are passed through the corresponding wire passage grooves 11, the rear holder 9 is slid along the wires 25 to be fitted into the receiving portion 7. Therefore, if the wires 25, extended from the receiving portion 7, are entangled, this entanglement must first be removed, and then the wires 25 are arranged in order, and then each wire 25 is passed through the corresponding wire passage groove 11. Thus, the attachment of the rear holder is troublesome, which has resulted in a problem that the efficiency of the operation has been lowered.

SUMMARY OF THE INVENTION

With the above problems in view, it is an object of this invention to provide a connector in which a wire-arranging operation before attachment of a rear holder can be omitted, while securing the function of preventing rearward withdrawal of terminals, thereby enhancing the efficiency of a connector-assembling operation.

The above object of the invention has been achieved by a connector wherein wires, connected respectively to terminals received respectively in terminal receiving chambers, are extended outwardly from a rear open portion of a connector housing, and a rear holder for preventing rearward withdrawal of the terminals is attached to the rear open portion in which the rear holder is slid in a direction perpendicular to a direction of extending of the wires to be attached to the rear open portion, and arranging walls are formed on the rear holder, and extend in the direction of sliding of the rear holder, wherein when the rear holder is attached to the rear open portion, each of the arranging walls is passed between the corresponding ones of the wires extended outwardly from the rear open portion.

In the connector, preferably, when the rear holder is attached to the rear open portion, the arranging walls are abutted respectively against rear ends of rubber plugs fitted respectively in the terminal receiving chambers.

In the connector, preferably, a wire-bending cover is mounted on the rear holder through a thin hinge portion, and after the rear holder is attached to the rear open portion, the wire-bending cover is moved to bend the wires in a direction perpendicular to the direction of extending of the wires from the rear open portion.

In the connector of this construction, the terminals as well as the waterproof rubber plugs are mounted in the respectively terminal receiving chambers, and in this condition when the rear holder is slid in the direction of extending of the wires to be attached to the rear open portion, each of the arranging walls is passed between the corresponding ones of the wires extending respectively from the terminal receiving chambers, so that entanglement of the wires is removed, and the wires are separated from one another in order, and at the same time each wire is guided into a gap between the arranging walls, thus arranging the wires in order.

In the connector, the arranging walls are adapted to be abutted respectively against the rear ends of the waterproof rubber plugs, and therefore the arranging walls are abutted respectively against the rear ends of the waterproof rubber plugs simultaneously when the rear holer is attached to the rear open portion, thereby preventing the terminals and the waterproof rubber plugs from being withdrawn rearwardly respectively from the terminal receiving chambers.

In the connector, the wire-bending cover is mounted on the rear holder, and after the rear holder is attached to the rear open portion, the wire-bending cover is pivotally moved to bend the wires in the predetermined direction while the wires are kept arranged in order.

DETAILED DESCRIPTION OF THE PREFERRED EMBODIMENT

Figure 1:
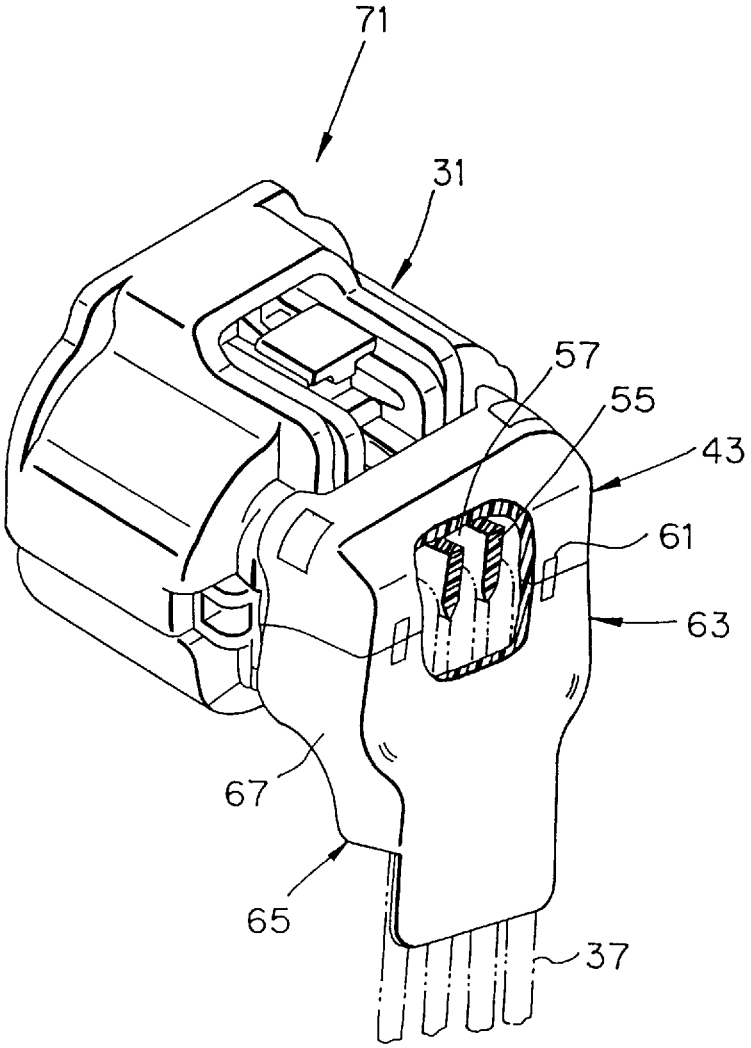
FIG. 1 is a partly-broken, perspective view of a connector of the present invention.
Figure 2:
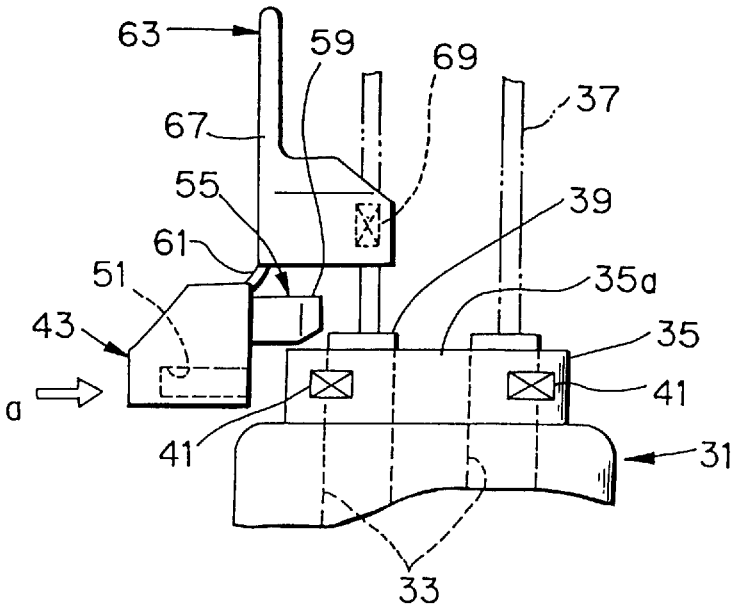
FIG. 2 is a side-elevational view of the connector of FIG. 1, showing a condition before a rear holder is attached to the connector.
Figure 3:
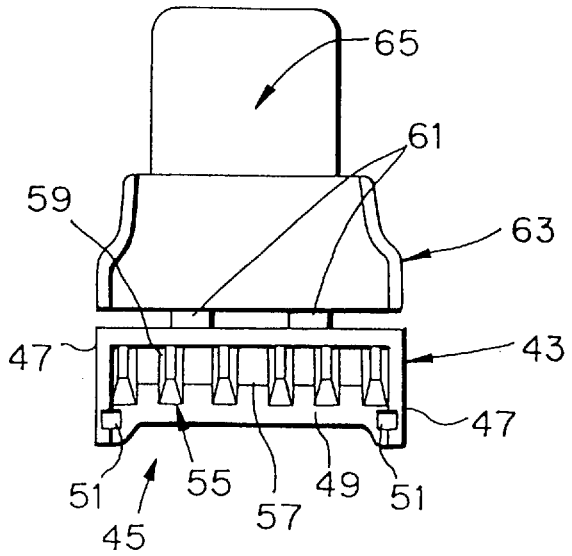
FIG. 3 is a front-elevational view of the rear holder shown in FIG. 2.
Figure 4:
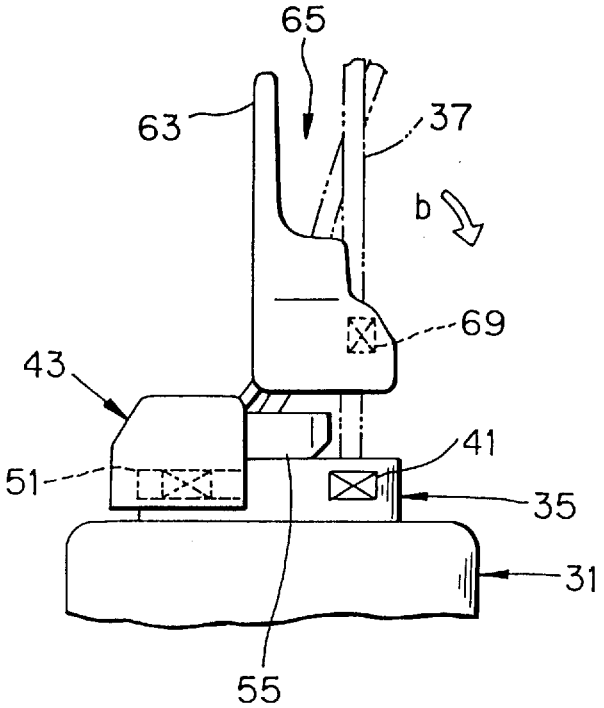
FIG. 4 is a side-elevational view of the connector of FIG. 1, showing a condition after the rear holder is attached to the connector.
Figure 5:
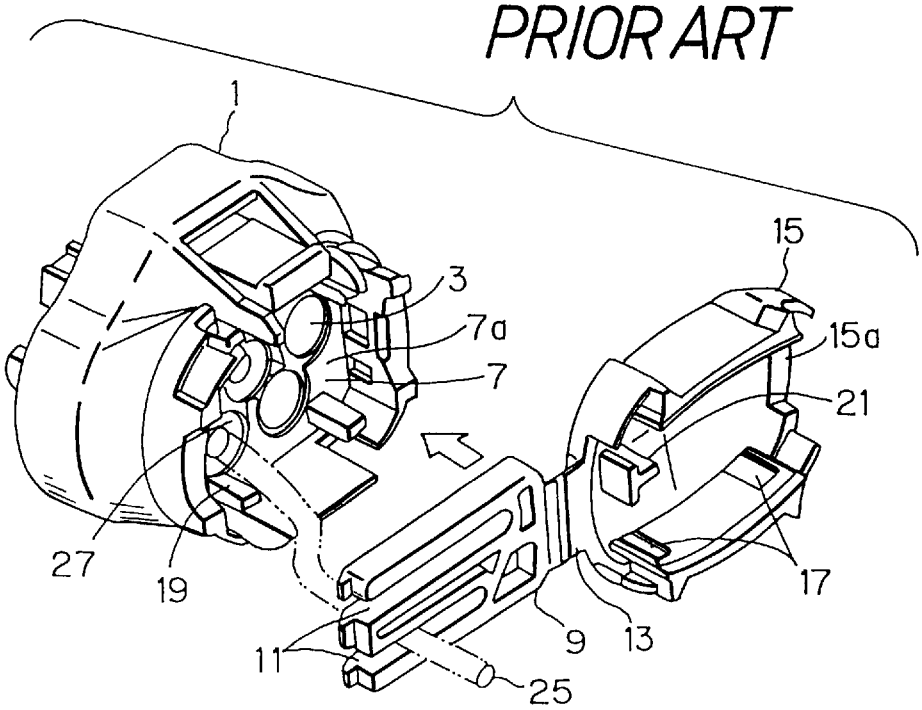
FIG. 5 PRIOR ART
FIG. 5 is an exploded, perspective view of a conventional connector provided with a rear holder.
Figure 6:
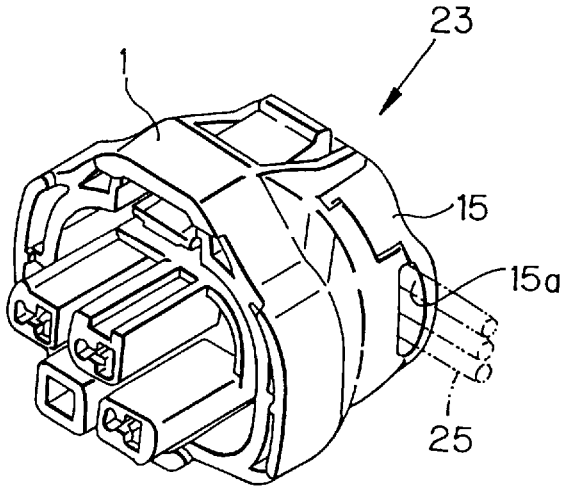
FIG. 6 PRIOR ART
FIG. 6 is an perspective view showing the appearance of the connector of FIG. 5 in its assembled condition.

A preferred embodiment of a connector of the present invention will now be described in detail with reference to the drawings. FIG. 1 is a partly-broken, perspective view of the connector of the invention, FIG. 2 is a side-elevational view of the connector of FIG. 1, showing a condition before a rear holder is attached to the connector, FIG. 3 is a front-elevational view of the rear holder shown in FIG. 2, and FIG. 4 is a side-elevational view of the connector of FIG. 1, showing a condition after the rear holder is attached to the connector.

A plurality of terminal receiving chambers 33 (indicated by broken lines in FIG. 2) are formed in a connector housing 31, and are open to a rear open portion 35 formed in a rear end of the connector housing 31. The rear open portion 35 is formed by a tubular outer wall portion 35*a* projecting from the rear end of the connector housing 31.

Terminals (not shown), clamped respectively to wires 37, are mounted in the terminal receiving chambers 33, respectively, and are extended outwardly from the rear open portion 35 in a terminal inserting-removing direction. A waterproof rubber plug 39 is mounted on the wire 37, and is fitted into the terminal receiving chamber 33 to form a watertight seal between the wire 37 and an inner surface of the terminal receiving chamber 33. At this time, each of the waterproof rubber plugs 39 is fitted in the corresponding terminal receiving chamber 33, with its rear end slightly projected outwardly therefrom (see FIG. 2). A plurality of retaining projections 41 are formed on the outer wall portion 35*a* of the rear open portion 35, and these retaining projections 41 serve to retain the rear holder and a protective cover described later.

The box-like rear holder 43 is adapted to be attached to the outer wall portion 35*a* of the rear open portion 35, and the rear holder 43 is open at its bottom, and one side of the rear holder 43 is open to provide an insertion port 45 continuous with this open bottom. As shown in FIG. 3, the rear holder 43 has a pair of side plates 47 between which the insertion port 45 is disposed, and a receiving portion 49 for receiving the rear open portion 35 is formed between the pair of side plates 47. The rear holder 43 is slid relative to the rear open portion 35 in a direction (indicated by arrow a in FIG. 2) perpendicular to the direction of extending of the wires 37, with the outer wall portion 35*a* of the rear open portion 35 received between the pair of side plates 47, so that the rear open portion 35 can be received in the receiving portion 49 through the insertion port 45.

An engagement groove 51 is formed in an inner surface of each of the two side plates 47, and extends in the direction (sliding direction) of sliding of the rear holder 43, and the engagement groove 51 engages the corresponding retaining projection 41 formed on the outer peripheral surface of the outer wall portion 35*a*. Therefore, the rear holder 43, having the engagement grooves 51 engaged respectively with the retaining projections 41, is slid in a direction of extending of the engagement grooves 51, while prevented from moving away from the rear open portion 35.

The rear holder 43 has a plurality of arranging walls 55 which extend in the sliding direction, and are juxtaposed between the pair of side walls 47, and a space or gap 57 is formed between any two adjacent arranging walls 55. Each arranging wall 55 has a distal end portion (tapering portion) 59 which is tapering or decreasing in thickness progressively toward its distal end. When the rear holder 43 is slidingly attached to the rear open portion 35, the tapering portions 59 force their way through the group of wires 37 extended from the rear open portion 35, and guide the wires 37 into the respective gaps 57 in order.

Also, when the rear holder 43 is attached to the rear open portion 35, the arranging walls 55 contact the rear ends of the respective waterproof rubber plugs 39 projecting slightly respectively from the terminal receiving chambers 33, thereby preventing the waterproof rubber plugs 39 from being withdrawn rearwardly from the terminal receiving chambers 33.

A wire-bending cover 63 is connected to the rear holder 43 through thin hinge portions 61, and that side of the wire-bending cover 61 remote from the thin hinge portions 63 is removed to provide a wire outlet port 65. A retaining recess 69 is formed in an inner surface of each of pair of side walls 67 between which the thin hinge portions 61 are disposed, and the retaining recesses 69 can be engaged respectively with the retaining projections 41 formed on the outer wall portion 35*a* of the rear open portion 35.

The operation of the connector 71 of this construction will now be described.

The terminals as well as the waterproof rubber plugs 39 are mounted respectively in the terminal receiving chambers 33, and in this condition when the rear holder 43 is slid relative to the rear open portion 35 in a direction perpendicular to the wire-extending direction, each of the arranging walls 55 is passed between the corresponding ones of the wires 37 extended from the respective terminal receiving chambers 33. The arranging walls 55 are thus passed through the group of wires, so that entanglement of the wires 37 is removed, and therefore the wires 37 are separated from one another in order, and at the same time the wires 37 are guided into the respective gaps 57, formed by the arranging walls 55, through the tapering portions 59, so that the wires 37 are arranged in order.

At this time, the arranging walls 55 contact the rear ends of the respective waterproof rubber plugs 39 projecting respectively from the terminal receiving chambers 33, and therefore the arranging walls 55 prevent the terminals, as well as the waterproof rubber plugs, from being withdrawn rearwardly.

In this condition, the wire-bending cover 63 is pivotally moved through the thin hinge portions 61 in a closing direction (indicated by arrow b in FIG. 4), and the retaining recesses 69 are engaged respectively with the retaining projections 41, thereby fixing the wire-bending cover 63 to the rear open portion 35, and also the wires 37, arranged in order, are bent, and are extended through the wire outlet port 65 in the wire-bending cover 63 in a predetermined direction, as shown in FIG. 1.

In the above connector 71, the rear holder 43 is slid in the direction perpendicular to the direction of extending of the wires 37 to be attached to the connector housing 31, and the juxtaposed arranging walls 55, extending in the sliding direction, are formed on the rear holder 43. Therefore, simultaneously when the rear holder 43 is attached to the connector housing 31, the arranging walls 55 remove the entanglement of the wires 37, and arrange the wires 37 in order. Thus, a troublesome operation for removing the entanglement of the wires 37 before attachment of the rear holder is omitted.

When the rear holder 43 is attached to the connector housing 31, the arranging walls 55 are abutted against the rear ends of the respective waterproof rubber plugs 39, and therefore simultaneously when arranging the wires 37 in order, the terminals, as well as the waterproof rubber plugs 39, are prevented from rearward withdrawal.

The wire-bending cover 63 is mounted on the rear holder 43 through the thin hinge portions 61, and therefore after the rear holder 43 is attached to the connector housing, the wire-bending cover 63 is pivotally moved, and is fixed to the rear open portion 35 by the retaining portions 69 and the retaining projections 41, so that the wires 37, extending in order from the respective terminal receiving chambers, are bent in the direction perpendicular to this wire-extending direction, while kept arranged in order.

As described in detail, in the present invention, the rear holder is slid in the direction perpendicular to the direction of extending of the wires to be attached to the connector housing, and the juxtaposed arranging walls, extending in the sliding direction, are formed on the rear holder. Therefore, simultaneously when the rear holder 43 is attached to the connector housing, the wires are arranged in order by the arranging walls. Thus, a troublesome operation for removing the entanglement of the wires is omitted, and therefore the efficiency of the connector-assembling operation can be greatly enhanced.

In the connector, the arranging walls are adapted to be abutted respectively against the rear ends of the waterproof rubber plugs, and therefore when the rear holder is attached to the connector housing, the rearward withdrawal of the terminals and the waterproof rubber plugs is prevented simultaneously when arranging the wires in order.

And besides, in the connector, the wire-bending cover is mounted on the rear holder, and after the rear holder is attached to the connector housing, the wire-bending cover is pivotally moved, so that the wires, extending in order from the respective terminal receiving chambers, are bent in the predetermined direction, while kept arranged in order.

What is claimed is:

1. A connector, comprising:

a housing:

terminal receiving chambers, for receiving terminals to which wires respectively connect, formed in said housing;

an opening portion formed at a rear end of said housing to extend said wires outwardly;

a rear holder, for preventing rearward withdrawal of said terminals, attached to said opening portion, said rear holder being slid in a direction perpendicular to the outwardly extending direction of said wires, to be attached to said opening portion; and arranging walls formed on said rear holder, and extending in the sliding direction of said rear holder, wherein when said rear holder is slid against the rear portion of said housing, each of said arranging walls is passed between the corresponding ones of said wires extended outwardly from said opening portion, so that said arranging walls untangle and arrange said wires.

2. The connector of claim 1, further comprising rubber plugs mounted on said wires, respectively, said rubber plugs being fitted into said terminal receiving chamber to form a watertight seal between said wires and inner surfaces of said terminal receiving chamber.

3. The connector of claim 2, wherein when said rear holder is attached to said opening portion, said arranging walls are abutted respectively against rear ends of said rubber plugs fitted respectively into said terminal receiving chambers.

4. The connector of claim 1, further comprising a wire-bending cover mounted on said rear holder through a hinge portion, and after said rear holder is attached to said opening portion, said wire-bending cover is moved to bend said wires in a direction perpendicular to the direction of extending of said wires from said opening portion.

5. The connector of claim 4, wherein said opening portion has an outer wall portion projecting from the rear end of said housing, and said outer wall portion has a plurality of retaining projections formed thereon.

6. The connector of claim 5, wherein said wire-bending cover has a retaining recesses formed in inner surfaces of a pair of side walls of said wire-bending cover between which said hinge portions are disposed.

7. The connector of claim 6, wherein said retaining recesses are engaged respectively with said retaining projections.

8. The connector of claim 1, wherein said opening portion having an outer wall portion projecting from the rear end of said housing.

9. The connector of claim 8, wherein said outer wall portion has a plurality of retaining projections formed thereon.

10. The connector of claim 9, further comprising engagement grooves, for engaging with the corresponding retaining projections, formed respectively in an inner surface of side plates of said rear holder, said engagement grooves extending in the sliding direction of said rear holder.

11. The connector of claim 1, wherein said arranging walls each has tapering surfaces.

* * * * *